United States Patent [19]

Ohishi et al.

[11] Patent Number: 5,053,735

[45] Date of Patent: Oct. 1, 1991

[54] REMOTELY-OPERATED CIRCUIT BREAKER

[75] Inventors: Hirotoshi Ohishi; Tatsunori Ikeda; Manabu Sogabe, all of Hiroshima, Japan

[73] Assignee: Mitsubishi Denki Kabushiki Kaisha, Tokyo, Japan

[21] Appl. No.: 418,192

[22] Filed: Oct. 6, 1989

[30] Foreign Application Priority Data

| | | | |
|---|---|---|---|
| Oct. 6, 1988 | [JP] | Japan | 63-131089[U] |
| Oct. 6, 1988 | [JP] | Japan | 63-252310 |
| Oct. 6, 1988 | [JP] | Japan | 63-252311 |
| Oct. 6, 1988 | [JP] | Japan | 63-252312 |
| Oct. 6, 1988 | [JP] | Japan | 63-252313 |

[51] Int. Cl.[5] ..... H01H 83/00

[52] U.S. Cl. ..... 335/14; 335/20

[58] Field of Search ..... 335/6, 16, 14, 20

[56] References Cited

U.S. PATENT DOCUMENTS

| | | | |
|---|---|---|---|
| Re. 32,882 | 3/1989 | Yokoyama et al. | 335/14 |
| 4,449,055 | 5/1984 | Greer et al. | 335/14 |
| 4,470,028 | 9/1984 | Vayre et al. | 335/16 |
| 4,623,859 | 11/1986 | Erickson et al. . | |
| 4,625,190 | 11/1986 | Loafer et al. | 335/20 |
| 4,631,507 | 12/1986 | Guery et al. . | |
| 4,636,760 | 1/1987 | Lee . | |
| 4,725,799 | 2/1988 | Bratkowski et al. | 335/14 |
| 4,855,698 | 8/1989 | Cohen et al. | 335/20 |
| 4,990,875 | 2/1991 | Lemarquand | 335/14 |

FOREIGN PATENT DOCUMENTS

| | | |
|---|---|---|
| 60-30029 | 2/1985 | Japan . |
| 62-15723 | 1/1987 | Japan . |

*Primary Examiner*—Leo P. Picard
*Assistant Examiner*—Lincoln Donovan
*Attorney, Agent, or Firm*—Burns, Doane, Swecker & Mathis

[57] ABSTRACT

A remotely operated circuit breaker comprises a handle which is selectively positioned at one of three operating positions: a handle off position into which the handle is manually positioned to forcibly open the electrical contacts in the circuit breaker; a handle auto position into which the handle is positioned manually so that the electrical contacts are driven to normally open and close by a control mechanism which in turn is controlled by an electromagnetic driving unit response to a remote control voltage applied thereto; and a trip position into which the handle is automatically positioned by the control mechanism and a forcible overcurrent protecting unit to and the electrical contacts are opened rapidly when an overcurrent as well as a short-circuit current flows through the electrical contacts.

10 Claims, 8 Drawing Sheets

REMOTELY-OPERATED CIRCUIT BREAKER

BACKGROUND OF THE INVENTION

1. Field of the Invention

The present invention relates to an improvement of a remotely operated circuit breaker, and more particularly to a remotely operated circuit breaker capable of being frequently operated with a long working life.

2. Background Art

FIG. 8 shows a prior art wiring flow diagram for a conventional three phase induction motor M. The induction motor M is connected to a power source (not shown) through a main-circuit open/close appliance in which independent circuit breakers 1 are connected in series with electromagnetic contactors 2 and inserted in each of three power lines connected to the power source.

The circuit breakers 1 and contactors 2 are so connected because the circuit breakers 1 are intended to protect the power line and electric equipment such as the main circuit appliances and the motor M from short-circuit or overload. The circuit breakers 1 are therefore designed to be operated less than 10,000 times. Thus, the breaker 1 is not suitable for switching the main power of the appliance where on/off operation of the circuit is very frequent. In addition, it is difficult to remotely operate the breaker.

Thus the electromagnetic contactors 2 are used for applications where circuits are frequently opened or closed. However, in the case where the contactors alone are used in the circuit, once a large current flows therethrough due to, for example, short-circuit or overcurrent in excess of the rated power of a load, the large current causes the contacts to melt, rendering the contacts useless. One way of overcoming the aforementioned drawbacks is to cascade the breakers 1 and the electromagnetic contactors 2 in series, permitting highly frequent and remote on-and-off operations of the circuit as well as the electrical contacts are prevented from melting.

In the case where the breakers 1 and the electromagnetic contactors are to be housed in a housing 3, not only they must be manufactured separately but also mounting the breakers and contactors and wiring between the electromagnetic contactors and the circuit breakers are complex. Further, a large space is required in the housing 3, leading to a large size of the breaker apparatus.

SUMMARY OF THE INVENTION

The present invention was made to solve the described shortcomings and an object of the invention is to provide a remotely operated circuit breaker capable of being frequently operated with a long working life.

The circuit breaker according to the invention is of a compact construction in a single moulded case circuit breaker in which normal frequent open/close operation of the circuit is carried out by means of an electromagnetic driving unit with a long working life while a high speed circuit breaking operation is carried out by means of a forcible overcurrent protection unit against overcurrents in excess of a rated capacity or a short-circuit current, i.e., excessive currents.

Another object of the invention is to provide a remotely operated circuit breaker in which the electrical contacts are prevented from being melted due to excessive current.

Another object of the invention is to provide a remotely operated circuit breaker in which deterioration of insulation performance due to arcing of the contacts can be prevented.

According to the present invention, a remotely operated circuit breaker comprises:

electrical contacts;

a control lever for controlling said electrical contacts to open and close;

an electromagnetic driving unit responsive to a remote control signal for selectably driving said control lever to open and close said electrical contacts;

a handle having a first position and a second position;

a control mechanism for holding said electrical contacts open when said handle is positioned in said first position, for allowing said control lever to operate under control of said electromagnetic driving unit when said handle is positioned in said second position, and for holding said electrical contacts open when an excessive current flows through said electrical contacts when said handle is positioned in said second position; and a forcible overcurrent protecting unit for actuating said control mechanism to latch said control lever such that said control lever is not controlled by said electromagnetic driving unit when said excessive current flows through said electrical contacts.

BRIEF DESCRIPTION OF THE DRAWINGS

Features and other objects of the invention will be more apparent form the description of preferred embodiments with reference to the drawings in which.

DESCRIPTION OF THE PREFERRED EMBODIMENTS

Operation Modes

The operation of a remotely operated circuit breaker according to the invention will now be with reference to FIGS. 1–6. The modes of operation of the circuit breaker of the invention includes the normal remote on/off operation mode, the overcurrent protection mode and the short-circuit protection mode.

Figure 1:
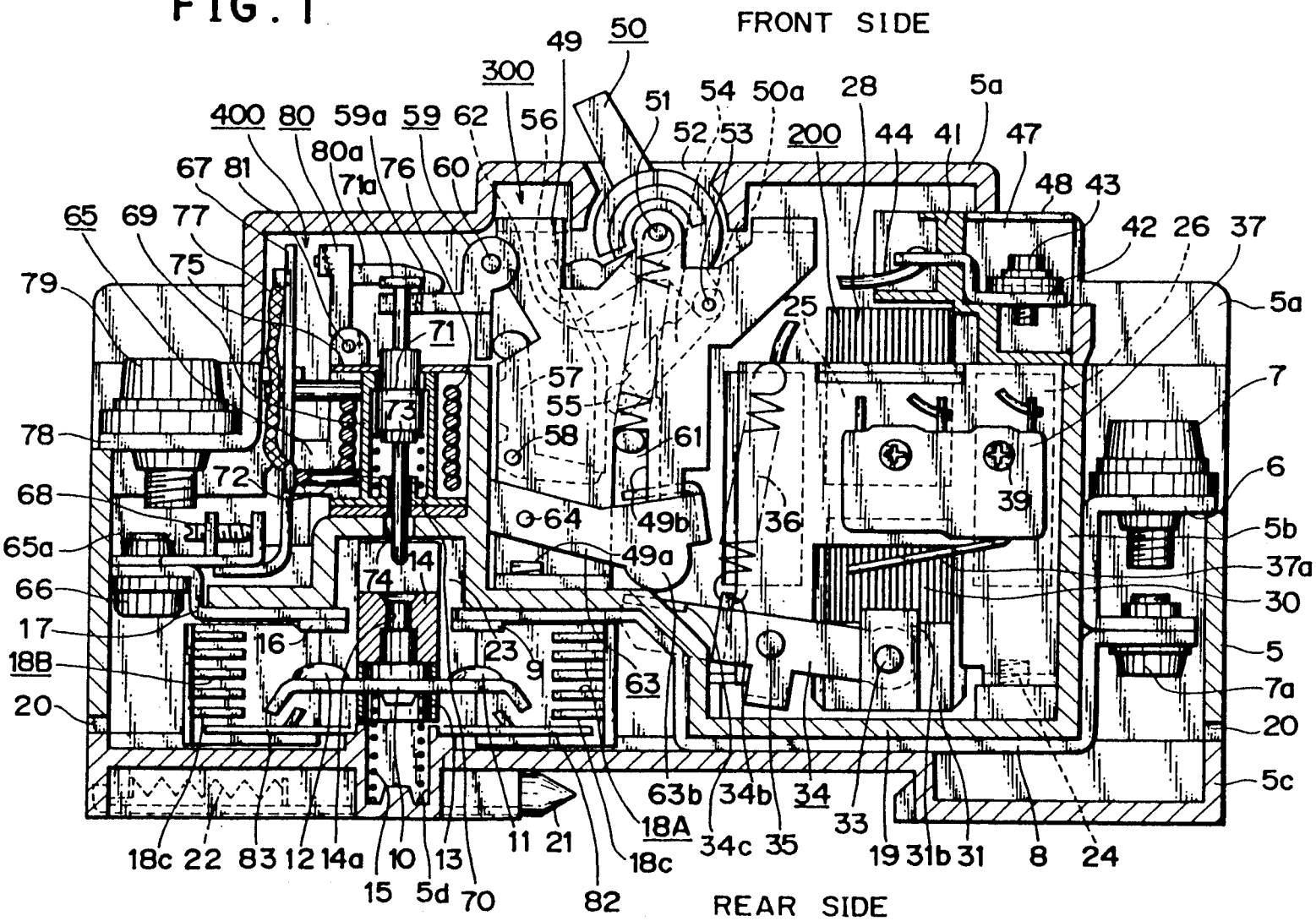
FIG. 1 is a cross-section side view of a remotely operated circuit breaker when a handle is positioned at a "handle off" position.
Figure 2:
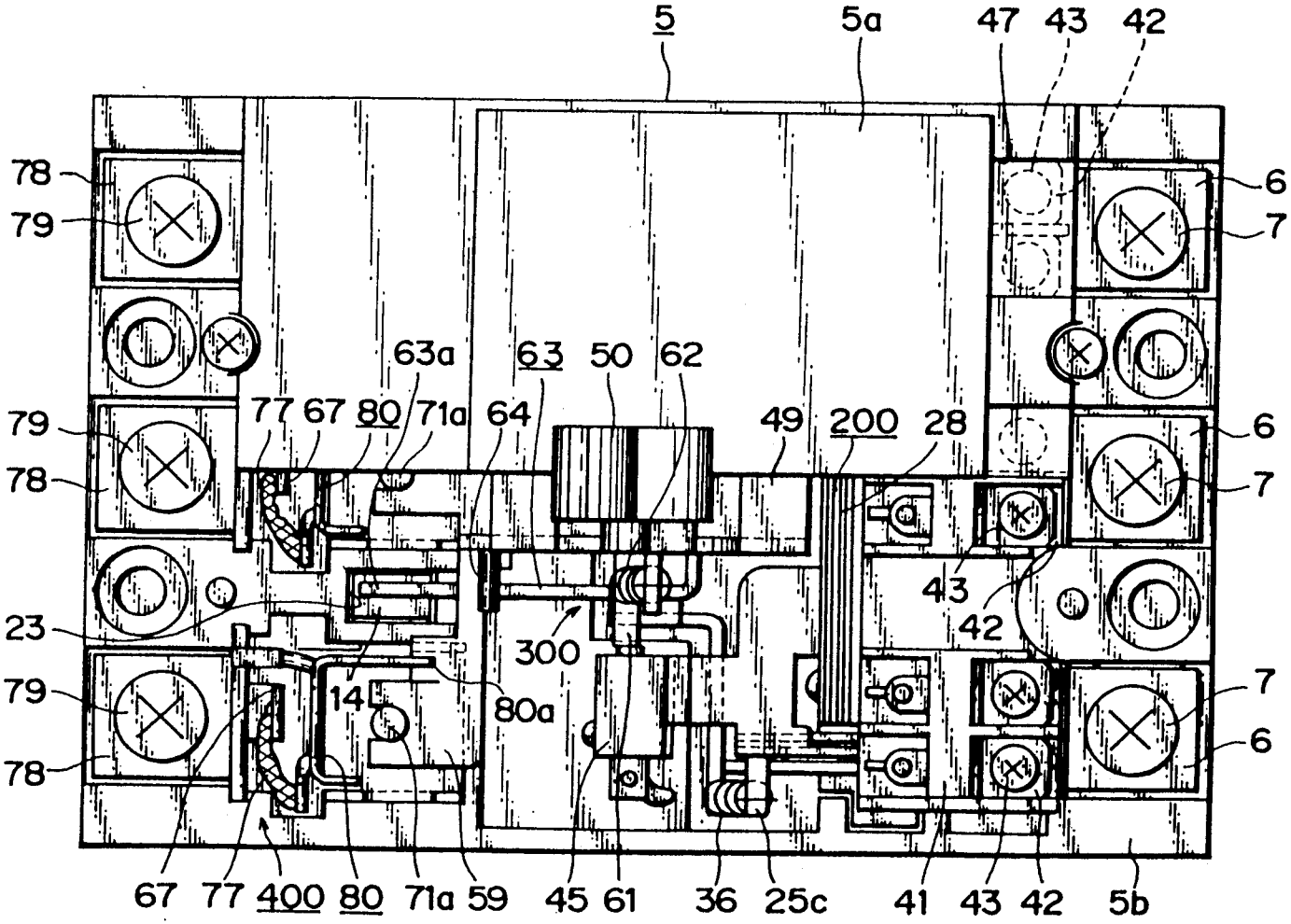
FIG. 2 is a front view of FIG. 1 with a front cover being partly broken.
Figure 3:
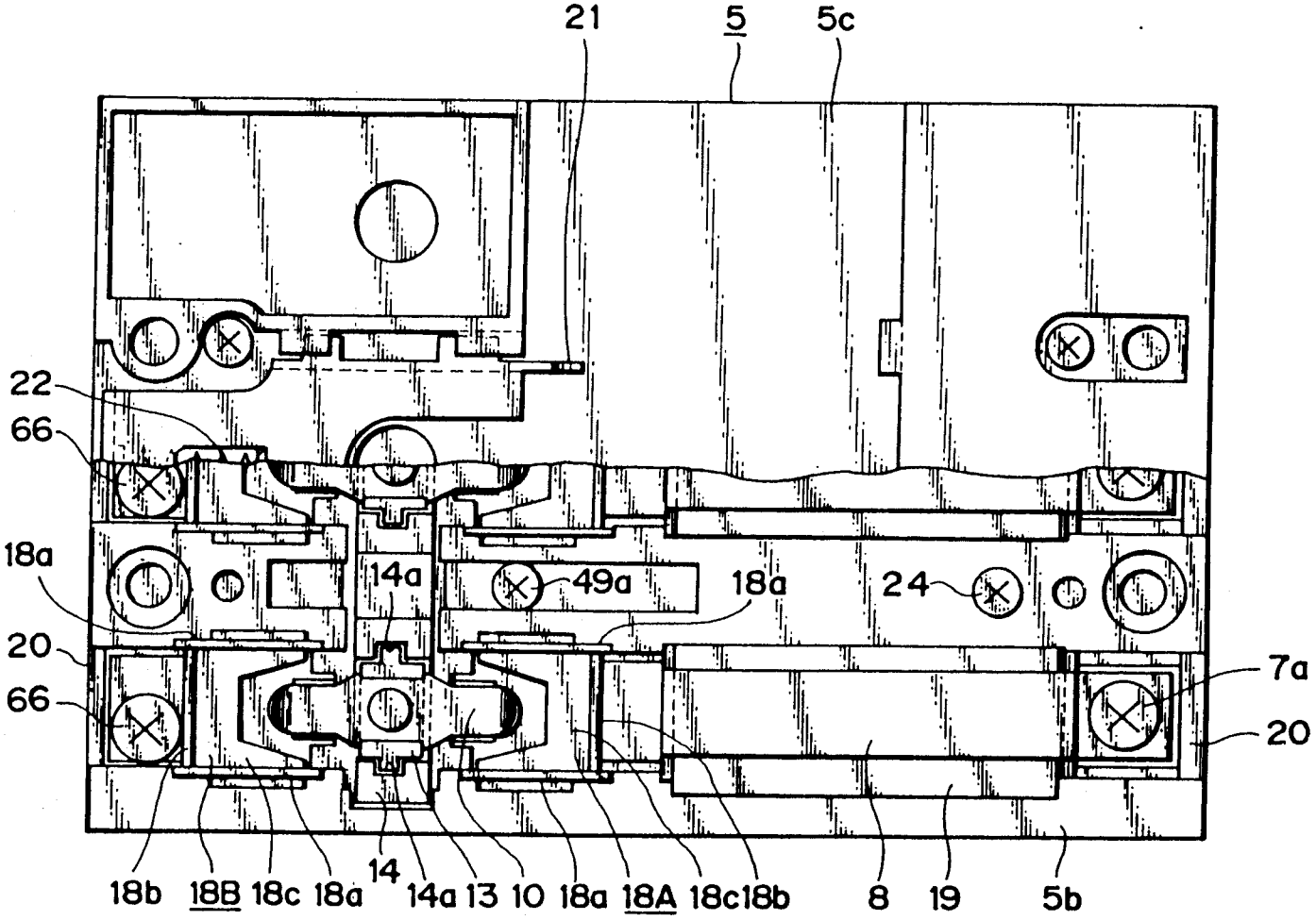
FIG. 3 is a rear view of FIG. 1 with a rear cover being partly cut away.

When a handle 50 is thrown to the right side from a "handle off" position shown in FIGS. 1–3 so that it is positioned at a "handle auto" position, a link 54 is in a substantially vertical position to push down a depressing plate 61 against the tensile force of a tension spring 62, releasing a control lever 63 which in turn is rotated clockwise by a compression spring 15 via a crossbar 14 through a small gap between a transmission lever 34 till it is stopped by a transmission lever 34 of an electromagnetic driving unit 200 urged by a pulling spring 36. The spring force of the pulling spring 36 is selected to be greater than that of the compression spring 15. At this time, a movable member 10 moves upwardly by a distance equal to the gap between the other end 63*b* of the control lever 63 and the engaging portion 34*c* of the transmission lever 34, allowing the distance between contacts 9, 11, 12, 16 to decrease somewhat as compared to that shown in FIGS. 1-3. The remotely operated circuit breaker is now ready for normal remote on/off operation.

Normal Remote Operation Mode

Figure 4:
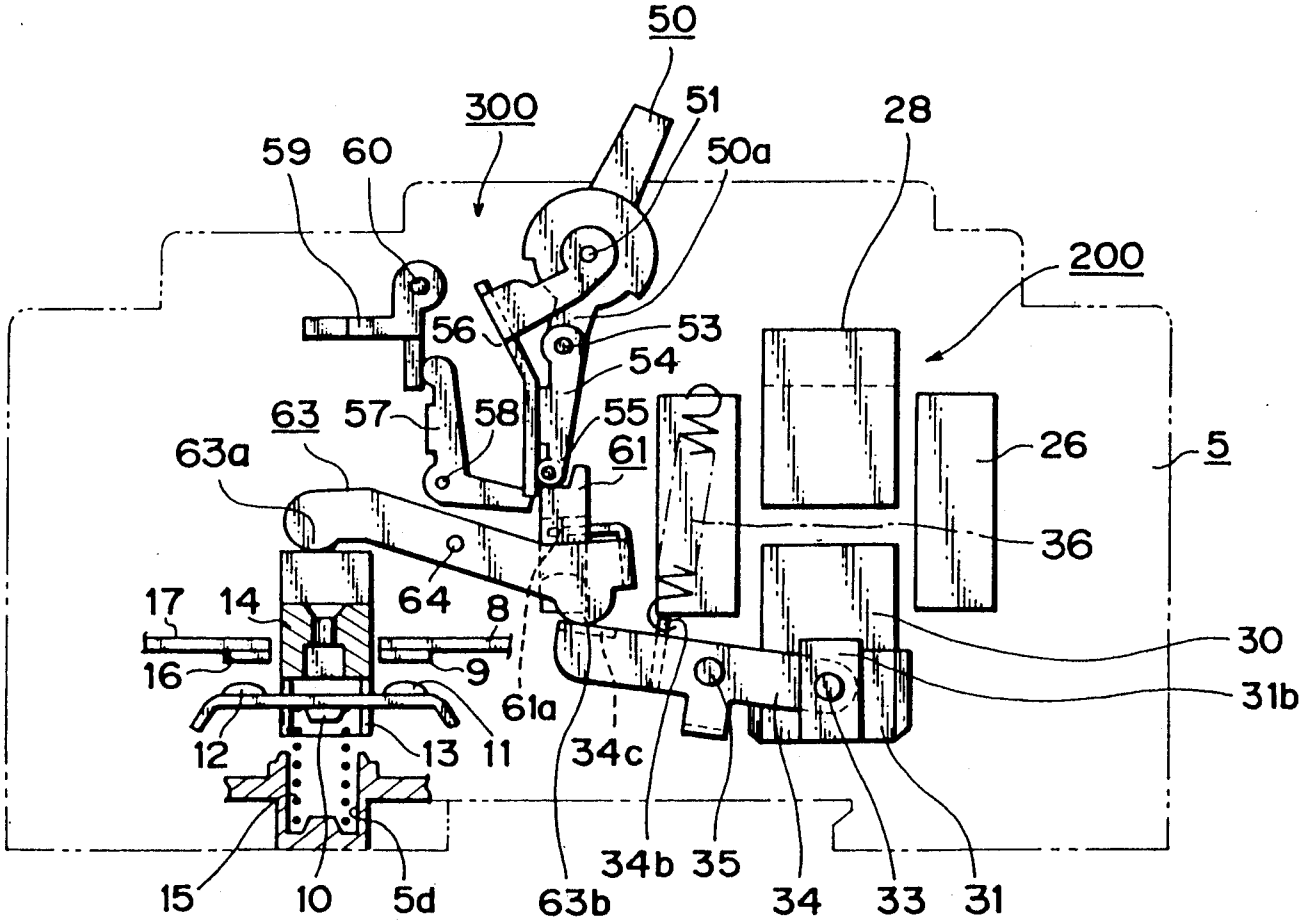
FIG. 4 is an illustrative diagram for showing the remotely operated circuit breaker in FIG. 1 when the handle is positioned at a "handle auto" position.

As shown in FIG. 4, with the handle 50 being at the "handle auto" position, a limit switch 45 detects the movement of the depressing plate 61 to become closed. When a remote control voltage is applied to terminals 42 from a remote external control means, a coil 26 is energized so that a fixed core 28 pulls a movable core 30 through attraction. Then the transmission lever 34 rotates counterclockwise against the spring force of the pulling spring 36 to release the control lever 63, which in turn causes the movable member 10 to move upwardly by virtue of the compression spring 15, closing the contacts 9, 11, 12, 16. Then electric power is supplied to a load connected to the circuit breaker.

Figure 5:
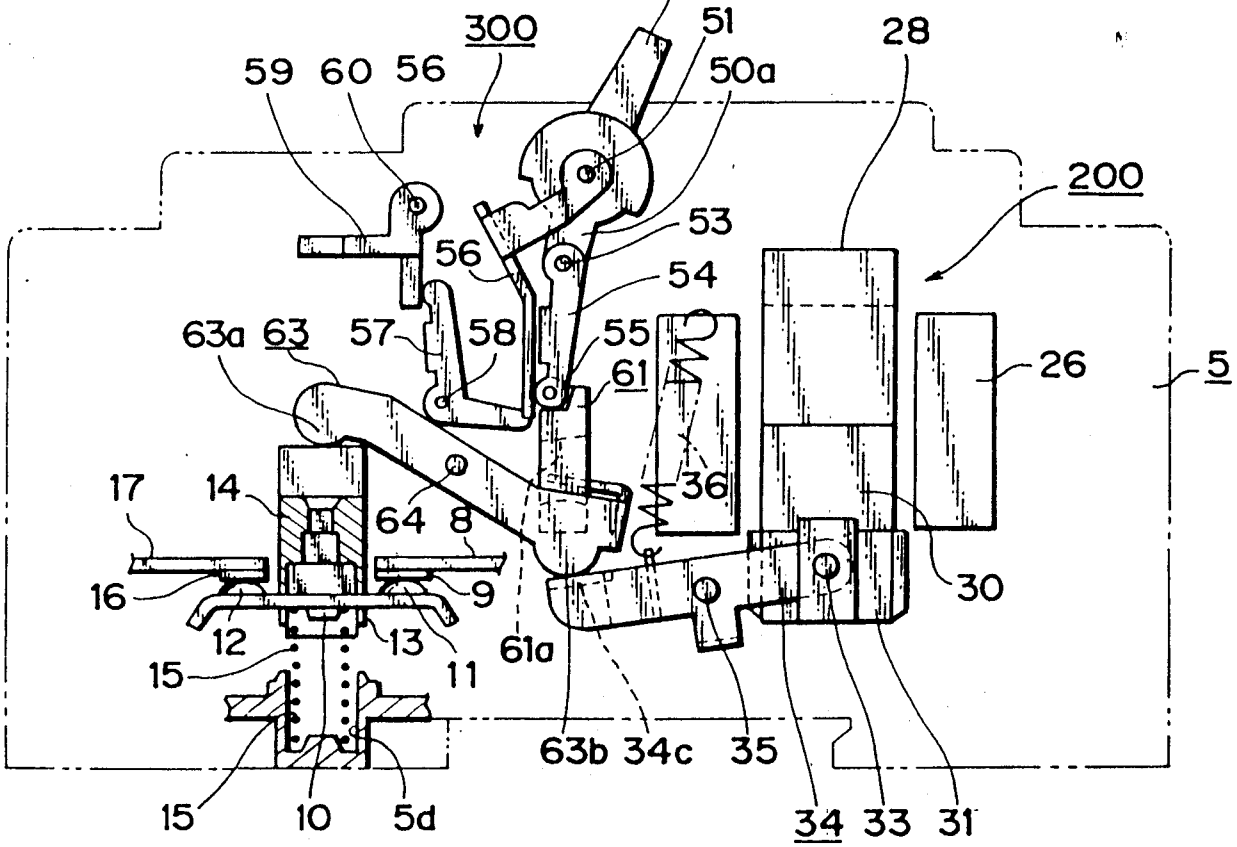
FIG. 5 is an illustrative diagram for showing the remotely operated circuit breaker in FIG. 1 when the handle being positioned at "handle auto" position.

FIG. 5 shows the positional relationship between these mechanical elements when the electromagnetic driving unit 200 is energized by the remote control voltage. At this time, projections 31*b* of a holder 31 push up actuators 37*a*, 38*a* of auxiliary switches 37, 38 to operate the auxiliary switches 37, 38. The movable core 30 strikes the fixed core 28 with an impact when attracted by the fixed core 28 but the impact force is absorbed by resilient members 29.

In FIG. 5, when the voltage applied to the terminals 42 is removed, the pulling spring 36 causes the movable core 30 to move away from the fixed core 28. The pulling spring 36 also causes the control lever 63 to rotate counterclockwise against the compression spring 15, opening the contacts 9, 11, 12, 16 to return to the condition in FIG. 4. In this manner, the contacts can be opened or closed through application of the remote control voltage from a remote station without the aid of a control mechanism 300. With the contacts being closed in FIG. 5, the load current flows in the order of power inlet terminals 6—inlet side fixed member 8—inlet side fixed contact 9—inlet side movable contact 11—the movable member 10—load side movable contact 12—load side fixed contact 16—load side fixed member 17—first yoke 65 —bimetal 67—flexible copper stranded wire 77—coil 76—load side terminal 78.

Overcurrent Protection Mode

Figure 6:
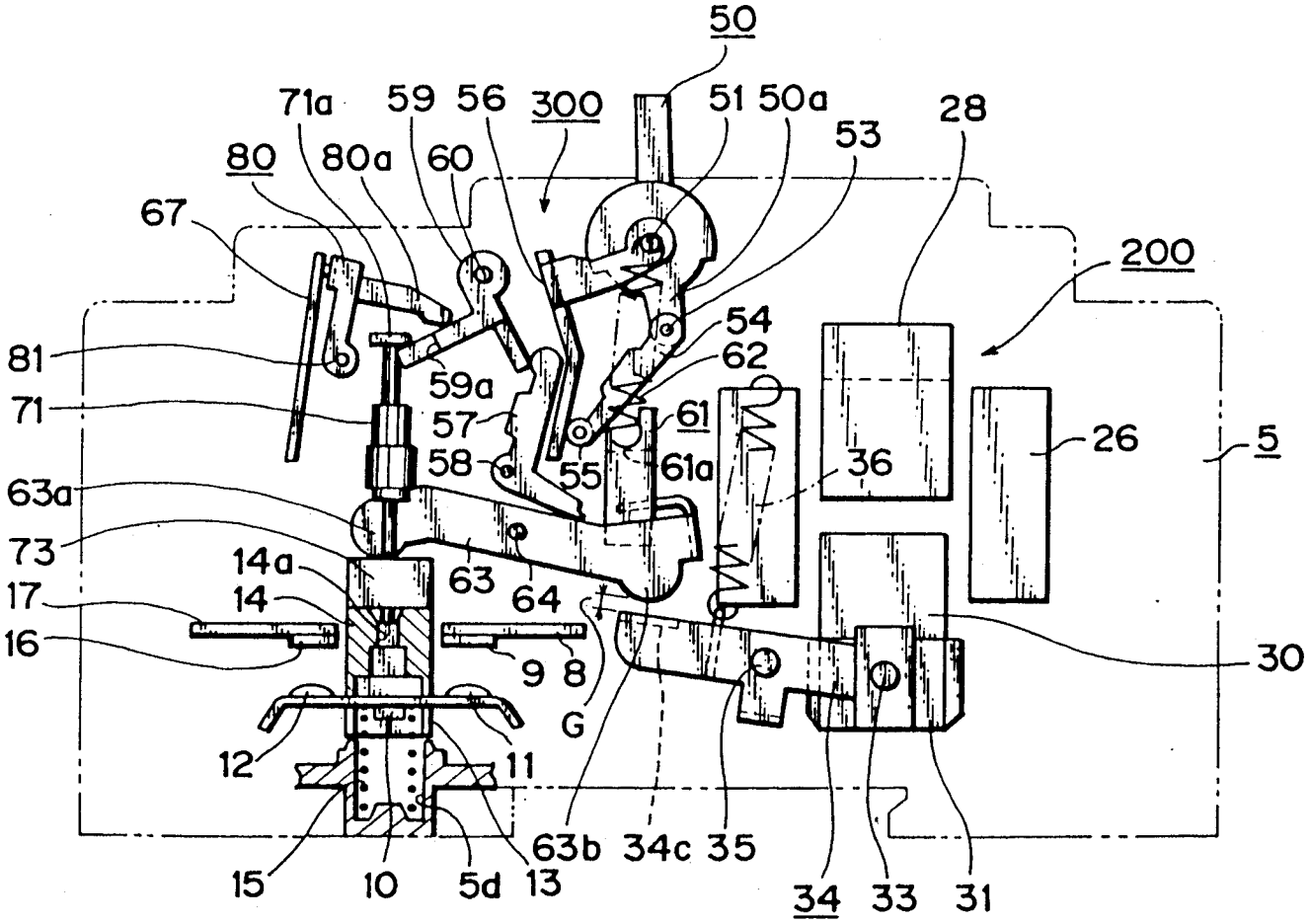
FIG. 6 is a diagram for showing the remotely operated circuit breaker in FIG. 1 when it is in a trip condition.

In FIG. 5, when an overcurrent in excess of a rated capacity of the circuit breaker flows for more than a predetermined period of time (generally shorter times for larger currents), the bimetal 67 deflects to the right side to cause, via an actuating strip 80, a trip bar 59 to rotate clockwise against a twist spring (not shown), which the trip bar 59 in turn causes a latch 57 to rotate clockwise against another twist spring. The clockwise rotation of the latch 57 releases the lever 56 from engagement with the latch 57, allowing the depressing plate 61 to jump upwardly pushing away a roller 55 together with the lever 56 to the left side. The upward movement of the depressing plate 61 causes the control lever 63 to rotate counterclockwise against the compressing spring 15, opening the contacts 9, 11, 12, 16; the breaker is now in a tripped condition which is shown in FIG. 6.

At this time, the limit switch 45 is also opened by the upward movement of the depressing plate 61, de-energizing the coil 26. Therefore, the movable core 30 is no longer attracted by the fixed core 28, just as in the case where the voltage to the terminals 42 is removed. Then the transmission lever 34 transmits a force to open the contacts 9, 11, 12, 16 through the control lever 63. That is, the resultant force of the tensile force of the tension spring 62 and the tensile force of the pulling spring 36 acts on the control lever 63 to quickly open the contacts 9, 11, 12, 16 against the compressing spring 15. Thus, not only the circuit breaker contacts are protected from being melted due to the overcurrent but also the power line is protected.

Short-Circuit Protection Mode

In FIG. 5, when a short-circuit current flows, the short-circuit current causes not only a coil 76 to instantly attract a plunger 71 toward a core 70 to strongly strike the movable member holder 13 through the rod 7 but also the trip bar 59 to rotate counterclockwise against a twist spring not shown to drive the control mechanism 300, so that the circuit breaker trips just as in the overcurrent protection mode described above. Actually, the rod 73 strikes movable member holder 13 much faster than the control the level 63 driven by the control mechanism 300.

In this manner, as soon as the short-circuit current flows, the contacts 9, 11, 12, 16 are opened quickly. Arcs developed between the contacts shift to between the movable member 10 and the respective fixed members 8, 17, and subsequently to between two arc runners 82, 83 and the respective fixed members 8, 17, thereafter to be extinguished by the respective grids 18*c*. The hot gas developed at the respective arc extinguishers 18A, 18B passes through holes in the respective exhaust plates 18*b* (not shown) into a gas exhausting path 19 and then discharges to the outside through holes 20. The pressure of the hot gas decreases due to the abrupt increase of space near the holes 20 to disperse melted compositions in the gas, assisting smooth exhaustion of the hot gas as well as reducing discharge of the melted compositions.

Resettinq Operation

Resetting operation is performed by manually throwing the handle 50 from the position in FIG. 6 to the left side, i.e., handle off position, so that the lever 56 pushes a roller 55 to the right side to thereby place the roller on the depressing plate 61 and then to subsequently move into pressure-contact engagement with the latch 57.

Then the handle 50 is manually thrown to the right side as shown in FIG. 4 from the "handle off" position shown in FIG. 1 so that a link 54 is in a substantially vertical position to push down a depressing plate 61 against the tensile force of the tension spring 62, releasing the control lever 63, which in turn is rotated clockwise by a compression spring 15 through a small gap between a transmission lever 34 till it is stopped by a transmission lever 34 of an electromagnetic driving unit 200 urged by the pulling spring 36. This completes the resetting operation, so that the circuit breaker is now ready for the normal operation mode.

Embodiments

A preferred embodiment of the present invention will now be described with reference to Figs. 1–7.

FIG. 1 is a side cross-section view of a remotely operated circuit breaker of the invention with a handle 50 at a "handle off" position. This three-phase circuit breaker has three power inlet terminals 6 and three power outlet terminals 79 as is seen from FIG. 2. A circuit breaker housing comprises a front cover 5*a*, a base 5*b*, and a rear cover 5*c*. Power inlet side terminals 6 are pressed into the base 5*b* and are provided with terminal screws 7. A power inlet side fixed member 8 is held at the rear side of the base 5*b* and is connected at its one end to the power inlet terminal 6 by means of a screw 7*a*. An inlet side fixed contact 9 is welded to the other end of the inlet side fixed member 8. A movable member 10 is provided with an inlet side movable contact 11 and a load side movable contact 12. A movable member holder 13 is made of an insulating material and holds the movable member 10 in fitting relation. A crossbar 14 extends across the three power lines and receives in its groove the movable member holder 13 in slidable fitting relation. By this slidable arrangement, the electrical contacts in each of the three lines may be closed with the same contact pressure. A compression spring 15 is received in a spring receiving portion 5*d* in the rear cover 5*c* and urges the movable member 10 upwardly.

A load side fixed contact 16 is welded to a load side fixed member 17 at a position opposite to the load side movable contact 12. Arc extinguishers 18A, 18B having grids made of magnetic material are disposed on the left and right sides of the movable member holder 13 and are enclosed by insulating walls 18*a* and exhaust plates 18*b*. A gas exhausting path 10 is defined by the base 5*b*, the insulating walls 10*a*, and the rear cover 5*c*, and has holes 20 for discharging the hot gas. A mounting assembly 21 is held slidably at the rear cover 5*c* and is urged toward the right side by a spring 22 as shown in FIG. 1. The crossbar 14 is mechanically coupled to the rest of the mechanism through an opening 23 in the base 5*b*.

In proximity to the power inlet terminal 6 on the front side of the base 5*b*, an electromagnetic driving unit 200 is secured to the base 5*b* by means of a screw 24.

Figure 7:
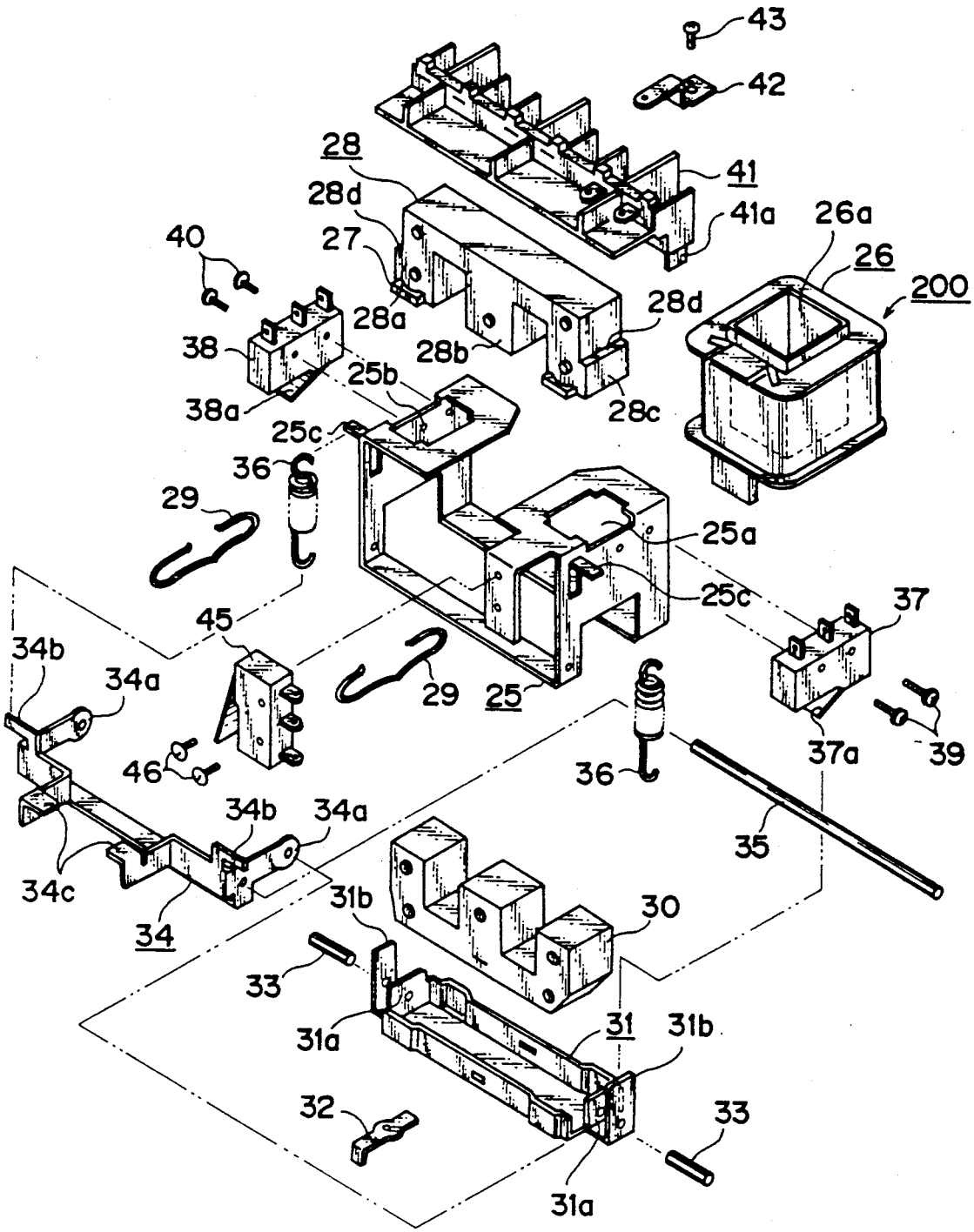
FIG. 7 is an exploded perspective view of an electromagnetic driving unit.
Figure 8:
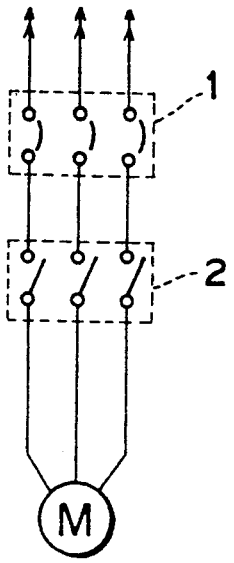
FIG. 8 PRIOR ART
FIG. 8 is a prior art wiring flow diagram for operating a three-phase induction motor.
Figure 9:
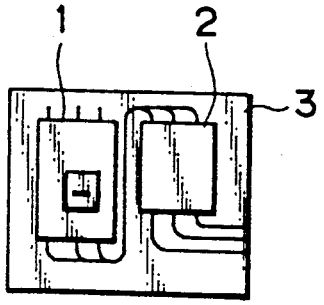
FIG. 9 PRIOR ART
FIG. 9 shows prior art circuit breakers and electromagnetic contactors connected in series.

As shown in FIG. 7, a solenoid 26 is inserted into a generally U-shaped magnet frame 25. Legs 28*a*–28*c* of a fixed core 28 to which shading coils 27 are secured, and inserted from above into openings 25*a*, 25*b* of the magnet frame 25 and a hole 26*a* of the solenoid 26. Resilient members 29 are inserted between the magnet frame 25 and the cutouts 28*d*, 28*d* of the core 28 not only to firmly hold the core 28 in the magnet frame 25 but also to resiliently absorb impact when a movable core 30 strikes the fixed core 28. The movable core 30 is secured to a stopper holder 31 by means of a stopper 32. On both ends of the holder 31 are provided bearings 31*a* through which the respective shaft 33 extend through bearings 34*a* to hingedly connect the holder 31 to a transmission lever 34. The transmission lever 34 is rotatably supported by the magnet frame 25 through a shaft 35 and is urged by a pulling spring 36 provided between projections 34*b* of the transmission lever 34 and projections 25*c* of the magnet frame 25 in a direction where the pulling spring 36 acts to separate the movable core 30 from the fixed core 28.

Auxiliary switches 37, 38 are fixed to the magnet frame 25 by means of screws 39, 40. Actuators 37*a*, 38*a* engage projections 31*b* of the holder 31 to be driven into open or closed position thereof in accordance with the movement of the movable core 30.

A terminal board 41 is provided with terminals 42 pressed thereinto and terminal screws 43 for electrical connection with external circuits. Of the six terminals 42, two pairs of terminals are connected to the auxiliary switches 37, 38 by means of lead wires 44 to provide signals indicative of ON-OFF condition of the electrical contacts, while one of a pair of inner terminals is connected to the solenoid 26 through the limit switch 45 and the other is directly connected to the solenoid 26. That is, the limit switch 45 is in series with the solenoid 26 of the electromagnetic driving unit 200. The limit switch 45 is fixed to the magnet frame 25 by means of screws 46. The terminal screws 43 are disposed so that electrical connection to the external circuits may be made through opening 47 in the front cover 5*a*. The terminal board 41 is fixed to the magnet frame 25 by means of short legs 41*a*. A terminal cover 48 is provided to enclose the terminal screws 43 of the terminal board 41 so that they are not directly exposed to the outside.

In the middle portion of the front side of the base 5*b* is disposed a control mechanism 300. A frame 49 is secured to the base 5*b* by means of a screw 49*a*. A handle 50 is rotatably supported by the frame 49 through a shaft 51 and is adapted to project to the outside through an opening 52 of the front cover 5*a* so that it may be manually operated. An inner projection 50*a* engages a link 54 through a pin 53 to form a toggle link mechanism. On the other end of the link 54 is rotatably journalled a roller 55. As shown in FIG. 4, a lever 56 is rotatably supported by the frame 49 through the shaft 51 and is at its tip end in pressure-contact engagement with the latch 57, which is rotatably supported by the frame 49 through a shaft 58 and is urged counterclockwise by a twist spring (not shown). A trip bar 59 is rotatably supported on a shaft 60 and is urged by another twist spring not shown to thereby engage the latch 57. A depressing plate 61, slidable in a vertical direction, is held within a groove 49*b* of the frame 49 and is urged upwardly by a tension spring 62. The depressing plate 61 supports the roller 55 on its upper end while also engaging the lever 56. Also supported through a shaft 64 on the frame 49 is the control lever 63 one end 63*a* of which engages the cross bar 14 while the other end of which engages an abutment 34*c* of the transmission lever 34 as well as a hole 61*a* in the depressing plate 61. In FIG. 1, the handle 50 is at the "handle off" position. Thus, the control lever 63 is urged counterclockwise by the tension spring 62 through the depressing plate 61. Since the spring force of the tension spring 62 is greater than that of the compression spring 15 that urges the movable member 10, the control lever 63 is held at the position shown in FIG. 1, thereby causing the contacts 9, 11, 12, 16 to be opened. It should be noted that there is a small gap between the other end 63*b* of the control lever 63 and the abutment 34*c* of the transmission lever 34. The gap allows mechanically decoupling of the transmission lever 34 and the control lever 63 when the handle 50 is positioned at the handle off position, so that application of the remote control voltage is no longer effective in controlling on and off operation of the contacts.

On the load side of the front of the base 5b is disposed a forcible overcurrent protecting unit 400 formed of a bimetal 67 and plunger type electromagnet. A first yoke 65 is connected at its one end 65a to the load side fixed member 17 by means of a screw 66 as shown in FIG. 1 and is provided with the bimetal 67 welded thereto and as adjusting screw 68 for the bimetal. A bobbin 69 is provided with a hollow core 70 caulked to the first yoke 65 and a plunger 71 which is urged upwardly by a detection compression spring 72. The tip end 71a of the plunger 71 engages a U-shaped cutout 59a of the trip bar 59 so that the plunger causes the trip bar 59 to rotate counterclockwise against a twist spring (not shown) when the plunger 71 is attracted toward the core 70. A rod 73 extends through the hollow portion of the core 70, a hole 74 in the base 5b, and a hole 14a in the cross bar 14 to as far as the movable member holder 13. Also, when the plunger 71 is attracted toward the core 70, the plunger 71 strikes the movable member holder 13 through the rod 73 to thereby open the contacts 9, 11, 12, 16. A second yoke 75 is caulked to the first yoke 65 and a coil 76 is seated between the first and second yokes 65, 75. The coil 76 is connected at one end thereof to the tip end portion of the bimetal by means of a flexible copper stranded wire 78 and at the other end thereof to the load side terminal 78. The load side terminal 78 is provided with a terminal screw 79 for making electrical connection to the external circuits. An actuator strip 80 is rotatably supported by the first yoke 65 by means of a shaft 81, is urged counterclockwise by a spring not shown, and has an arm 80a that engages the trip bar 59. The time required for the contacts 9, 11, 12, 16 to be opened is adjusted by threading the adjusting bolt 68 to vary the gap between the tip end of the bimetal and the actuator strip 80.

The invention has been described above in terms of specific embodiments merely to elucidate the principles of the invention. It will be apparent to one having ordinary skill in the art that the invention could be otherwise embodied without departing from its principles. The embodiments are therefore illustrative rather than restrictive. The invention is not limited to these embodiments, but is instead fully commensurate in scope with the following claims.

What is claimed is:

1. A remotely operated circuit breaker comprising:

electrical contacts;

a control lever for controlling said electrical contacts to open and close;

an electromagnetic driving unit responsive to a remote control signal for selectably driving said control lever to open and close said electrical contacts;

a handle having a first position and a second position;

a control mechanism for holding said electrical contacts open when said handle is positioned in said first position, for allowing said control lever to operate under control of said electromagnetic driving unit when said handle is positioned in said second position, and for holding said electrical contacts open when an excessive current flows through said electrical contacts when said handle is positioned in said second position; and a forcible overcurrent protecting unit for actuating said control mechanism to latch said control lever such that said control lever is not controlled by said electromagnetic driving unit when said excessive current flows through said electrical contacts.

2. A remotely operated circuit breaker according to claim 1, wherein said electromagnetic driving unit includes a fixed core, an electromagnetic coil for magnetizing said fixed core in response to said remote control signal, and a movable core attracted by said fixed core.

3. A remotely operated circuit breaker according to claim 1, wherein said breaker further comprises a housing formed of a front cover, a rear cover, and a base disposed between said front cover and said rear cover, said base having a front side facing said front cover and a rear side facing said rear cover, said base supporting on said front side said control mechanism, said electromagnetic driving unit, and said forcible overcurrent protecting unit, said base supporting on said rear side said electrical contacts which are enclosed by insulating walls.

4. A remotely operated circuit breaker according to claim 3, wherein said base has partition walls provided thereon and said rear cover has holes in side walls thereof for communication with the atmosphere; and said partition walls, said base, and said rear cover forming a gas exhausting path directed to said holes.

5. A remotely operated circuit breaker according to claim 1, wherein said forcible overcurrent protecting unit includes a plunger type electromagnet having a plunger which strikes said electrical contacts to rapidly open said electrical contacts.

6. A remotely operated circuit breaker according to claim 3, wherein said circuit breaker has a plurality of poles and said further wherein said circuit breaker includes a housing formed of a front cover, a rear cover, and a base disposed between said front cover and said rear cover, said base having walls for isolating each of said plurality of poles from one another, and said control lever movably extends into said isolating wall.

7. A remotely operated circuit breaker according to claim 1, wherein said circuit breaker further comprises a transmission lever provided between said electromagnetic driving unit and said control lever, and a clearance between said transmission lever and said control lever when said handle is positioned at said first position.

8. A remotely operated circuit breaker according to claim 1, wherein said first position is a handle off position into which said handle is manually positioned to manually open said electrical contacts, said second position into which said handle is manually positioned for permitting remote control of said open and close operation.

9. A remotely operated circuit breaker according to claim 1, wherein said handle further has a trip position into which said handle is automatically positioned when said current in excess of said predetermined value flows through said electrical contacts with said handle being positioned at said handle auto position.

10. A remotely operated circuit breaker according to claim 1, wherein said forcible overcurrent protecting unit includes a bimetal and an electromagnet connected in series with said electrical contacts, said bimetal actuating said control mechanism to latch said control lever such that said control lever is brought out of control of said electromagnetic driving unit when said excessive current flows through said electrical contacts, and said electromagnet directly forcing said electrical contacts to rapidly open while also actuating said control mechanism to latch said control lever such that said control lever is not controlled by said electromagnetic driving unit when a short-circuit current flows through said electrical contacts.

* * * * *